United States Patent [19]

Wagner

[11] Patent Number: 4,925,438

[45] Date of Patent: May 15, 1990

[54] BAGS MADE OF A THERMOPLASTIC SYNTHETIC RESIN SHEETING AND PROCESS FOR THE PRODUCTION OF SAID BAGS

[75] Inventor: Robert Wagner, Troisdorf-Sieglar, Fed. Rep. of Germany

[73] Assignee: Stiegler GmbH Maschinenfabrik, Troisdorf-Sieglar, Fed. Rep. of Germany

[21] Appl. No.: 228,506

[22] Filed: Aug. 5, 1988

[30] Foreign Application Priority Data

Aug. 5, 1987 [DE] Fed. Rep. of Germany ..... 3725878

[51] Int. Cl.[5] ..... B31B 31/86; B31B 31/82

[52] U.S. Cl. ..... 493/194; 493/195; 493/926

[58] Field of Search ..... 493/194, 195, 196, 197, 493/198, 226, 926

[56] References Cited

U.S. PATENT DOCUMENTS

| | | | |
|---|---|---|---|
| 3,395,622 | 8/1968 | Kugler | 493/196 |
| 3,656,415 | 4/1972 | Hook | 493/196 |
| 4,181,069 | 1/1980 | Porter | 493/196 |
| 4,605,392 | 8/1986 | Achelpohl et al. | 493/196 |
| 4,609,366 | 9/1986 | Ley et al. | 493/22 |

*Primary Examiner*—William Terell

*Attorney, Agent, or Firm*—Antonelli, Terry & Wands

[57] ABSTRACT

Bags, especially shopping bags, of a thermoplastic synthetic resin sheeting, are made to be free-standing. In the process for the production of the bags, the bags are provided in pairs. Each bag is provided with a handle hole and designed as a standing bag having an approximately sinusoidal load-bearing rim, with lateral cutoff weld seams and with a bottom pleat, with corner weld seams provided separately in the two pleat sections of the bottom pleat and extending from the bag sides obliquely toward the bag bottom, and with a flat bottom formed by the corner weld seams.

5 Claims, 7 Drawing Sheets

FIG.1
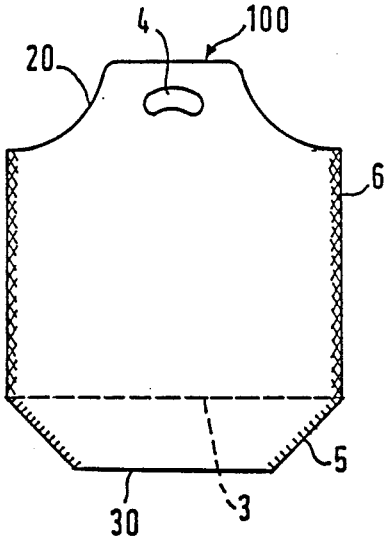
FIG.2
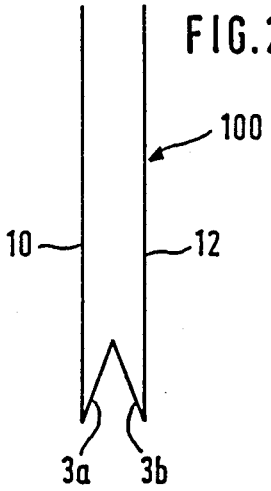
FIG.3
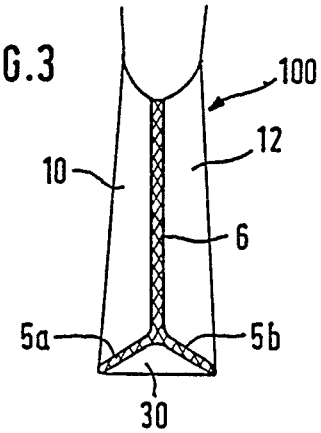
FIG.5
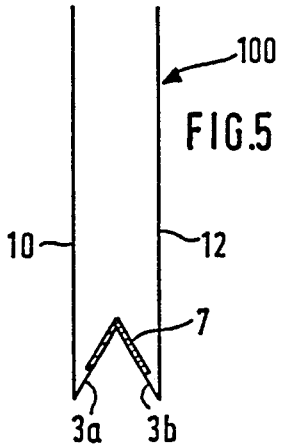
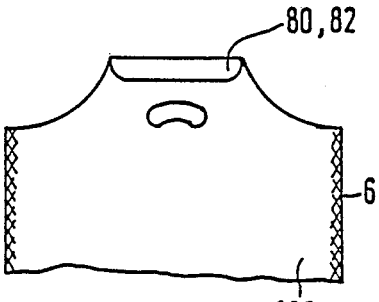
FIG.6
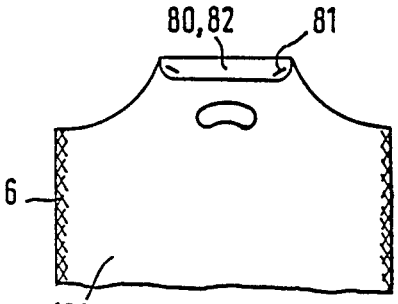
FIG.7

BAGS MADE OF A THERMOPLASTIC SYNTHETIC RESIN SHEETING AND PROCESS FOR THE PRODUCTION OF SAID BAGS

This invention relates to bags made of a thermoplastic synthetic resin sheeting with or without handle holes, and especially shopping bags having adequate rigidity for self-supporting free standing of the bags on a flat bottom, and to a process for producing these bags.

Shopping bags of thermoplastic synthetic resin sheeting are known in various designs. The designs are essentially dependent on the purpose of usage.

For square-shaped packaging goods, shopping bags are desired having a high, i.e., optimum filling volume, as they are known, for example, in the form of shopping bags having lateral pleats or bottom pleats of thermoplastic synthetic resin sheeting. The filling volume of shopping bags or sacks is furthermore increased or improved by the formation of square bottoms which are provided, for example, in case of shopping bags, sacks or large bags equipped with side pleats, by corner weld seams; see, for example, DOS 3 530,070.

This invention has a primary object of providing a shopping bag, lunch bag or the like carrying bags of synthetic resin sheeting with relatively small as well as relatively large dimensions which is usable, in particular, also as a standing bag during packing and which make flawless filling possible in a quick and perfect fashion, with products that are to retain a specific standing direction. Standing bags are usually manufactured of paper or the like, especially with so-called collapsible bottoms, rather than being made of synthetic resin sheeting.

According to the invention, a shopping bag of thermoplastic synthetic resin sheeting with a handle hole is provided, fashioned with an approximately sinusoidal load-bearing rim, with lateral cutoff weld seams, and with a bottom pleat, with corner weld seams provided separately in the two pleat sections of a bottom crease and extending from the sides of the bag obliquely toward the bag bottom, and exhibiting a flat bottom formed by the corner weld seams. The corner weld seams for producing the flat bottoms can be designed as flush contact weld seams, in which case, depending on the configuration of the finished shopping bag, the corner sections can be subsequently removed by punching or cutting off. When forming double corners for two adjoining bags, it is also possible and advantageous to fashion the corner weld seams as cutoff weld seams with simultaneous severing of the projecting corner sections.

Thermoplastic synthetic resin sheets having high rigidity are used for producing the shopping bag according to this invention in order to provide for the self-supporting free standing of the bag when the flat bottom is deployed and the bag is placed upright (vertically) on an appropriate supporting surface. In this context, the stiffness of the synthetic resin sheeting is chosen so that the bag walls do not collapse and cover the flat bottom but rather stand essentially upright or, in the partially folded condition, still stand upright in order to make it possible to flawlessly deposit a packaged product or the like object on the flat bottom in the bag.

In order to obtain a shopping bag of plastic sheeting even with minor wall thicknesses, 20–30 μm, exhibiting a certain rigidity permitting the self-supported standing of the bag opened for filling and/or affording the property that the bag will automatically remain the opened position, the invention proposes to use a synthetic resin sheeting of a thermoplastic such as polyethylene that is embossed unilaterally or bilaterally. The embossed pattern can be arbitrary and can be designed with a very small penetration depth which simultaneously imparts a matte appearance to the sheet and, in case of transparent sheets, also reduces transparency. In accordance with a preferred embodiment, a unilaterally embossed synthetic resin sheet is utilized in such a way that the embossed side of the sheeting forms the insides of the bag. In such a case, the shopping bag exhibits a smooth, robust and readily printable surface and, at the same time, the bag can be readily opened and the inside walls separated for filling purposes since these walls, on account of the slightly profiled surfaces, do not adhere to each other as strongly as smooth, unembossed surfaces of synthetic resin sheeting. Due to the at least unilateral and preferably unilateral embossing of the sheeting of the shopping bags, the stiffness of the sheeting is increased, thereby improving the self-supported standing feature even in case of very thin films. For reasons of pricing, the use of films having a thickness of about 20–30 μm or 40 μm is contemplated in particular. Self-supporting standing bags made of a correspondingly thicker and thus stiffer sheeting are too expensive and are uneconomical for many usages on account of the larger amount of material consumed. An advantageous embodiment of the shopping bag provides that a composite plastic film is utilized obtained from at least two layers or plies of the same material or of different materials, joined together by unilateral embossing. Thus, it is possible, for example, to double a plastic film having a thickness of 10 μm to 20 μm and block same together by embossing, the embossing being performed with such imprints at elevated temperatures which, upon permanent deformation—embossing—of the synthetic resin simultaneously afford heat sealing and, respectively, adhesive bonding, by the embossed print, to the second ply of a plastic film in contact therewith. In this way, it is also feasible to join films of differing materials having differing properties into composite film by embossing and, in particular, to produce standing bags for filling with foods, which bags exhibit the properties required for this purpose, especially also steam and water tightness.

For improving and increasing the load-bearing capacity, on the one hand, and especially also the design of the flat bottom and thus the standing ability of the bag, especially a shopping bag, the flat bottom is reinforced at least in part by an additional reinforcing strip, particularly of a thermoplastic synthetic resin film applied adhesively on the outside or inside, for example, by welding or gluing. It is also possible to form the flat bottom from a zone of the synthetic resin film that has been thickened by extrusion as compared with the remaining bag film. This reinforced bottom region can also encompass, beyond the flat bottom, the adjoining zone of the bag walls.

Further advantageous embodiments according to this invention for a shopping bag with lateral cutoff weld seams and with a bottom pleat having corner weld seams ar hereinafter described in greater detail. In this connection, the provision is made in particular to fashion the bags not only in loose packs but also selectively as an interlocked pack with hanging holes and tear-off perforation or with a reinforced carrying handle zone.

In order to increase the strength and tearing-out resistance of the lateral seams of the shopping bags, a further provision of the invention provides that the lateral cutoff weld seams in each case are formed from a flush seam made by contact welding and from a cutoff weld seam superimposed thereon. Thus, according to the invention, the lateral seam or bottom seam is designed as a cutoff weld seam reinforced by the initial welding of a flush seam, i.e., a wide seam. This improves the leak-proofness of the shopping bags with respect to the efflux of liquids, the load-bearing capacity, and also the standing ability in the opened condition for filling purposes.

A preferred field of use for the bags of this invention as a standing bag resides in the packaging of edible goods, such as snacks, also known as "fast food" wherein these packs should be watertight, i.e., secure against efflux of liquids, and should also be of an opaque material. Also, the bags should have a certain inherent rigidity so that they remain standing upright by themselves during filling in the opened condition. The invention here offers, in place of paper bags, carrying bags of synthetic resin film which satisfy these requirements and are also leak-proof, do not permit penetration of moisture and grease and prevent soiling of the environment and of the persons coming in contact with the bags. In contrast to paper bags which tear after having been penetrated by moisture, the carrying bags of this invention, designed as standing bags and made of a thermoplastic synthetic resin film, retain their tear resistance even if moistened through. Moreover, carrying bags according to this invention with lateral cutoff weld seam and with a bottom pleat can also be designed with a means for closing the bag opening or aperture after filling. In such bags which may be equipped with a sealing fold and with a cove or other arrangement for closing the opening, the products can be transported as a closed package—protected from heat and cold and in an odorless fashion.

For the manufacturing procedure of the carrying bags of this invention, a tubular film or a flat film can be the starting material. For the paired production of the shopping bags with lateral cutoff weld seams, a tubular film is preferably the starting point for the formation of loose carrying bags; this tubular film, in the form of a laid-flat tubular sheet, is separated into two sheets by means of a centrally extending sinusoidal severing cut. The sheets are pulled apart and further transported with wave crests and troughs in parallel to each other in a mirror-image relationship and—if this has not been done before—then at this point in time lateral pleats are inserted along the longitudinal folding edges of the sheets. Depending on the features desired, the handle holes are now punched, in a cyclic operation, and the corner weld seams of two successive bags are welded in the two folded portions of each lateral pleat in an angular shape either as a flush seam or a cutoff weld seam with separation of the corner sections, and the bags are cut to length in pairs by transverse cutoff welding with formation of the lateral cutoff weld seams and separation of the corner weld seam angles. This process can be varied, for example, by partially folding over the sinus crests of one or both superimposed film plies toward the inside or outside and by welding the folded-over flaps in place for reinforcing the grasping zone of the carrying bag. With an only one-sided folding over of a wave crest, the other wave crest can be used for design as a blocking rim with tear-off perforation and hanging holes for the production of interlocked packs of carrying bags. The provision of the tear-off perforation and optionally of hanging holes can be performed cyclically prior to or after welding of the corner weld seams in one or both film plies.

In order to attain high production rates, it can be advantageous to perform a continuous process, solely, up to the transverse cutoff welding step, and to effect the discontinuous working steps only thereafter, such as punching of handle holes, perforation, punching of hanging holes, especially to perform this work on the stacked bags within the stack, along with the interlocking step.

A flat film, advantageously for double-sheet manufacture, can be the starting material, in particular, for the formation of carrying bags having lateral cutoff weld seams, a standing bottom, and a cover for the opening in the form of folded-over flaps, sealing folds, or the like. A tubular film can be linearly cut apart centrally on one side, and an opening gap can be produced by pulling apart and/or folding over of the film edges, or a flat film can be folded into a tube having a central opening gap, the latter being in any event wider than the amplitude height of the sinusoidal severing cut to be produced subsequently; then, on the film ply lying in opposition to the opening gap, a sinusoidal severing cut extending in the longitudinal direction can be performed, and the cut-open semitubular sheets can be offset with respect to each other at the same height of the wave crests and wave troughs, lateral pleats can be inserted along the side edges and, along the linear opening edges, the film rims for the unilateral flap edge can be folded over toward the inside or outside, especially they can be folded over to such an extent that the wave trough extends just outside of the flap rim; handle holes can be punched in below the wave crest into the folded-over zone of the film, pass-through slots can be punched in along the folded-over flap edge, along with optionally tear-off perforations and hanging holes, and the corner weld seams of two successive bags in angular shape can be welded into the two pleat portions of each side crease, either in the form of a flush seam or as a cutoff weld seam with severing of the corner sections; and then, by transverse cutoff welding with formation of the lateral cutoff weld seams and separation of the corner weld seam angles, the bags can be cut to length in pairs. Thereafter, the bags are stacked, and the stack is finished further, as described hereinabove.

While the insertion of the lateral pleats, severing, folding over of the edges, are performed continuously, the perforating, punching and welding operations are effected in cyclic synchronism and with intermittent sheet feed. In this connection, the sequence of the individual operating steps can be readily varied. It is also possible to operate perforating and punching units only after the stacking of the bags, in the collected pack. For the production of carrying bags with sealing fold, the unilaterally inwardly folded flap rim is folded inwards in a W-shape. In this arrangement, the W-shaped fold can be formed at an identical or differing leg height. For passing the protruding flap of the other, not folded film edge therethrough, a pass-through slot is punched into the folded-over edge of the flap rim.

Additional embodiments of the shopping bags and of the manufacturing procedures in accordance with the invention will be described in greater detail below with reference to the drawings showing thereof. In the drawings:

FIG. 1 shows a front elevational view of a carrying bag with flat bottom and lateral cutoff weld seams;

FIG. 2 is a schematic longitudinal section taken through FIG. 1;

FIG. 3 is a lateral view of FIG. 1 with the bottom being deployed;

FIG. 5 is a schematic cross-section through a carrying bag with a reinforced flat bottom;

FIGS. 6 through 11 show modified carrying bags with lateral cutoff weld seams and flat bottom according to FIG. 1 in fragmentary views;

Figure 4:
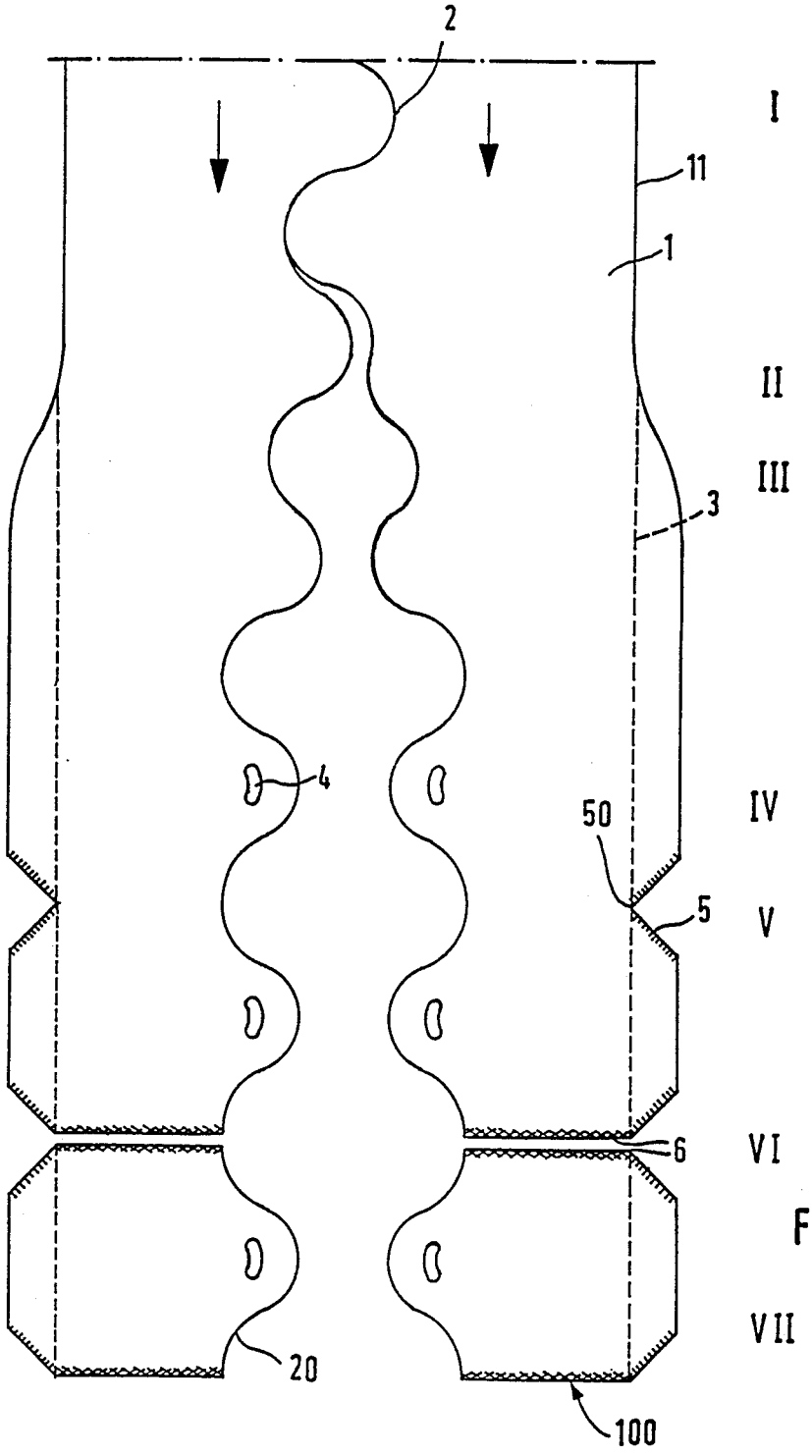
FIG. 4 shows a schematic manufacturing sequence for a carrying bag according to FIG. 1.

FIG. 1 shows the carrying bag 100 made of thermoplastic synthetic resin film (unilaterally embossed) with a sinusoidal load-bearing rim 20, a handle hole 4, lateral cutoff weld seams 6, a bottom pleat 3, corner weld seams 5 extending obliquely from the lateral cutoff weld seams 6 to the bottom edges these corner weld seams forming the square bottom 30, in a single design.

FIG. 2 shows schematically a longitudinal section through the bag 100 of FIG. 1 with rear wall 10, front wall 12, and the two folded bottom portions 3*a*, 3*b*. In a preferred embodiment of the invention, the bottom fold 3 is reinforced, as schematically illustrated in the longitudinal sectional view of FIG. 5. In this arrangement, a reinforcing insert 7, e.g., a reinforcing strip of thermoplastic synthetic resin film, optionally also of a thermoplastic synthetic resin film reinforced by a fabric or the like or by a nonwoven material, can be provided; this reinforcing insert 7 can be applied adhesively to the bottom pleat either on the inside or on the outside, and this reinforcing insert can extend over the bottom pleat partially or entirely or also past the edge up into the sidewalls 10, 12. The reinforcing insert can be glued on, for example. However, an especially advantageous application is made possible by welding, spot welding, grid-like welding, especially in partial areas. The reinforcing insert 7 enhances the structure of the flat bottom for standing the bag upright, and also increases standing stability and load-bearing ability.

FIG. 3 shows schematically a lateral view of the shopping bag 100 according to FIG. 1 with the flat bottom 30 being deployed; this bottom is also called a "square bottom". The figure also shows the extension of the lateral cutoff weld seam 6 and the corner weld seams 5*a*, 5*b* emanating from the lateral cutoff weld seam 6 and running obliquely toward the bottom pleat edges of the bottom pleat portions 3*a*, 3*b*; the flat bottom 30 is then formed between these corner weld seams. In the carrying bag according to FIG. 1 with a sinusoidal rim, the projecting flap of the load-bearing rim along the sinusoidal wave crest, as shown by way of the partial view in FIG. 6, can also be folded over toward the outside or inside as a flap 80, 82 for the rear wall and front wall of the bag 100, and can optionally be welded to the bag walls at selected locations 81, as schematically shown in front elevational view in FIG. 7. In this way, the handle and tearing-out strength are improved in the zone of the carrying rim and the handle hole.

Figure 8:
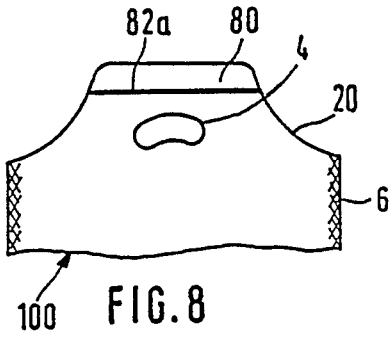

It is also possible to further develop the carrying bag with sinusoidal rim according to FIG. 1 in such a way, as shown in the fragmentary view of FIG. 8, that unilaterally at the front wall 12 of the bag, the load-bearing rim, i.e., the sinusoidal wave crest, is punched away above the handle hole 4 extending along the edge 82*a* in parallel to the bottom pleat, there remaining the flap 80 projecting on the rear wall of the bag beyond the front edge 82*a*. In the bag 100 according to FIG. 8, the edge 82*a* then forms a grasping rim for the facilitated opening of the bag for filling.

Figure 11:
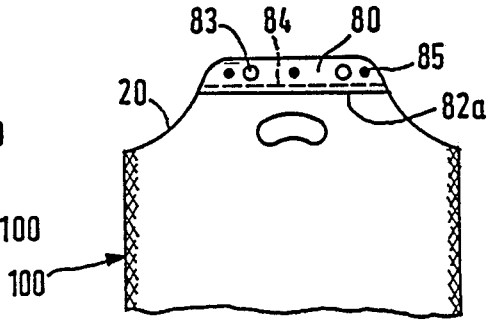

It is also possible to utilize the projecting flap 80 of the carrying bag of FIG. 8, as illustrated in FIG. 11, for the manufacture of tear-off bags from an interlocked pack. In this case, the flap 80 is provided with a tear-off perforation 84 in parallel to the edge 82*a* of the front side of the bag, and the projecting flap 80 is interlocked at certain locations with further flaps 80 of additional bags (see the interlocking areas 85), and is furthermore provided with at least one hanging hole 83. The bags 100 interlocked in the pack can then either be opened by grasping the edge 82*a* while they are still hanging from the bag pack and can thus be filled and then torn off from the interlocked pack 80 along the tear-off perforation.

Figure 9:
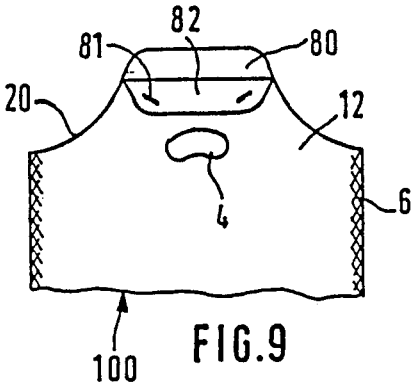
Figure 10:
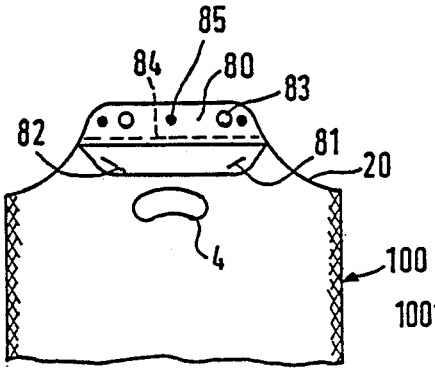

It is likewise feasible to further develop the carrying bag 100 with sinusoidal rim according to FIG. 1 as shown in FIG. 9, in that the wave crest 82 is partially folded over toward the outside only on one side on the front wall 12 of the bag, and is welded at locations 81 to the front wall; whereas the wave crest flap 80 projecting past the front wall 12 can be utilized, if desired, for interlocking 85 with further bags and flaps 80, as illustrated in FIG. 10. In such a case, the projecting flap 80 according to FIG. 10 is likewise provided with a tear-off perforation 84 in parallel to the folded-over edge of the flap 82 of the front wall, and with suspension holes 83. Also, in the bags of FIGS. 9 and 10, a simple accessing possibility for opening the bag 100 is created by the folded-over flap 82 of the front wall. In the bags according to FIGS. 10 and 11, the rearward projecting flap 80 forms practically the interlocking rim for the bags collected in the pack and interlocked. In order to obtain a large filling aperture, it is advantageous to fashion the sinusoidal carrying rim with a correspondingly deeply scalloped shape so that it encompasses in all cases the grasping hole and/or the zone of the grasping hole.

FIG. 4 shows schematically a possibility for manufacturing the bags of FIGS. 1 through 11. For a double-web manufacturing procedure, a laid-flat tubular film 1, which has been unilaterally embossed, forms the starting material which is then cut open by means of a sinusoidal cut 2 for the production of two rows of bags in parallel. The cut-open tubular sheets are then moved somewhat apart and further conducted offset with respect to each other in such a way that wave troughs and wave crests of the sinusoidal cut are further transported at the same level in order to be able to simultaneously perform the further finishing steps, such as punching of the handle hole, provision of corner weld seams, transverse cutoff welding for producing the lateral seams 6. After the tubular sheet 1 has been cut open in the cutting station I and after the separating and parallel conductance of the cut-open tubular sheets in Station II, the insertion of the bottom pleats 3 can take place, for example, in station III along the longitudinal edges 11. In the subsequent station IV, punching in of the handle hole 4 can be carried out, for example, and in the subsequent station V or in the same cycle with punching the handle hole, the angular transverse cutoff welding of the corner weld seams 5 can be performed by means of a corner welding unit in the individual pleat sections of the inserted bottom pleats 3. If it is intended to additionally provide folded-over flaps at the wave crests of the load-bearing rim, as, for example, in accordance with FIGS. 9 and 10, or sections as in FIGS. 8 and 11, or bilateral flaps as in FIGS. 6 and 7 for the carrying bags, then corresponding folding-over units and optionally spot welding units can be provided for this purpose downstream or upstream of the handle hole punching unit IV. It is also possible to further develop the carrying bag of FIG. 6 so that a higher marginal flap is folded over toward the outside or inside, is at least in some areas fixedly welded to the bag walls, and the handle hole is then punched into this double-wall zone of the folded-over flaps. The thus-finished semitube is then passed on to the transverse cutoff welding station VI wherein the bags 100 are cyclically cut to size by transverse cutoff welding. The lateral cutoff weld seams 6 are placed so that they extend over the inner corner 50 of the corner weld seams. In the embodiment of FIG. 4, the provision is made that the corner weld seams 5 are likewise designed as cutoff weld seams with simultaneous cutting apart of the corner sections. It is likewise possible to design the corner weld seams 5 as flush weld seams produced by contact welding, wherein the corner sections can optionally be removed later on by a separate cutting step.

The thus-manufactured bags 100 with a sinusoidal rim 20 are collected, downstream of the transverse welding station VI, in the accumulation and depositing station VII into packs and, if desired, passed on to further finishing. If the bags, as illustrated in FIGS. 10 and 11, are to be interconnected along a projecting flap 80, then this can be done as early as during the successive collection in station VII. In the same way, it is also possible to effect there, or in a further station, the punching of the hanging holes 83 and of the tear-off perforation 84.

A preferred further development of the bag having a sinusoidal rim with a flat bottom is to provide same with a folded-over flap denoted as inverting flap or insert flap which permits the sealing or partial closing of the bag opening after filling. The bag 100 with load-bearing rim according to FIG. 12 having lateral cutoff weld seams 6, a bottom pleat 3 and corner weld seams 5 exhibits at the bag opening the section formed at the rear bag wall 10 with a sinusoidal carrying rim 20 and projecting beyond the front wall of the bag, namely the flap 80; see also FIG. 14. In the zone of the bag opening A, at the front wall 12 of the carrying bag 100, the front wall is folded inwardly over the entire width of the bag and welded along the side edges of the bag having the lateral cutoff weld seams to the bag walls, forming an inverting flap 82. In the central zone of the folded-over edge of the inverting flap 82, a pass-through slot 86 is punched out. Through this pass-through slot 86, fashioned with adequate width, the flap 80 of the rearward bag wall 10, projecting in correspondence with the folding height H of the inverting flap 82 or to a greater extent, can be passed whereby the bag opening A is sealed. The handle hole 4 is punched centrally through the bag in the zone of the inverting flap 82 and permits carrying even with the bag being sealed. For reasons of manufacturing technique, the sinusoidal load-bearing rim 20 of the flap 80 of the rearward bag wall 10 terminates below the level H of the inverting flap 82 at the side edges 6 of the bag 100.

Figure 12:
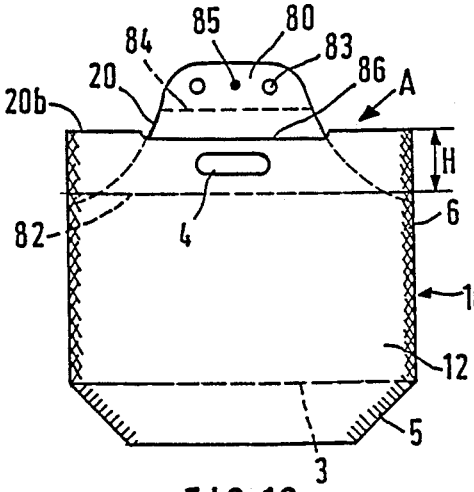
FIGS. 12 and 13 show, respectively, a carrying bag with lateral cutoff weld seams and insert flap in a plan view and in schematic cross-sections.
Figure 16:
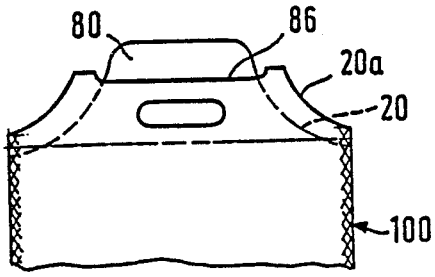

FIGS. 13*a*, 13*b* and 13*c* represent, respectively, a schematic longitudinal section through the bag 100 according to FIG. 12, showing the front wall 12 with folded inverting flap 82 and the pass-through slot 86 punched out at the folding edge, the bottom pleat with the pleat portions 3*a*, 3*b*, and the rearward bag wall 10 with the sinusoidal flap 80 projecting past the inverting edge of the front wall; this flap 80, according to FIG. 13*b*, can be passed through the pass-through slot 86 and, as indicated schematically in FIG. 13*c*, can thereafter be additionally folded over in the downward direction in order to reinforce the handle hole while carrying the bag. In the carrying bag of FIG. 12, the projecting flap 80 of the rear wall furthermore serves for interlocking with additional flaps of other bags. The bags can be separated from the interlocked zone along the perforation line 84. The interlocking zone also exhibits hanging holes 83 for suspending the interlocked pack of bags. The front wall of the bag with the folded-over inverting flap and pass-through slot exhibits a straight carrying rim 20*b* forming simultaneously a readily grasped gripping edge for opening the bag. It is possible to fashion the linear carrying rim 20*b* also furthermore by an additional punching or cutting step in a sinus shape by size reduction, as illustrated, for example, in FIG. 16 by the punched edge 20*a*. In this arrangement, the punching cut is to be performed, however, by cutoff welding so that the inverting flap remains attached.

Figure 13:
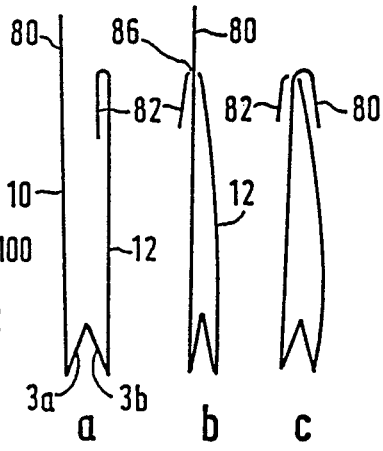
Figure 14:
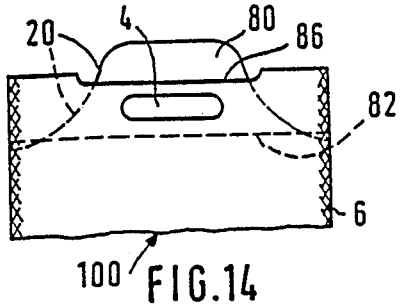
FIGS. 14 through 16 show variations of a bag according to FIG. 12.
Figure 15:
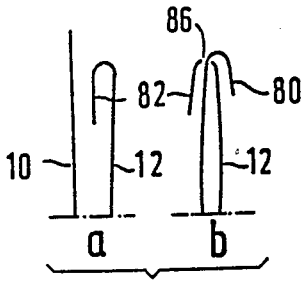

FIGS. 14 and 15 show the analogous functions of the bag described in FIGS. 12 and 13, but without interlocking and tear-off perforation. The bags 100 according to FIGS. 12 to 16 are thus distinguished by a loosely interlocked form with an inverting flap folded unilaterally toward the inside, with unilateral pass-through sinusoidal rim flap, and square-shaped bottom pleat as a flat bottom, and corner beveling by cutoff welding with corner weld. A special characterizing feature of the bag with flat bottom, bottom pleat and lateral cutoff weld seams and inverting flap according to FIGS. 12 to 16 resides in the differing, i.e., unequal formations of the carrying rim along the front and rear walls of the bag. In this connection, the rear wall always exhibits a more strongly pronounced sinusoidal rim than the front wall.

Figure 20:
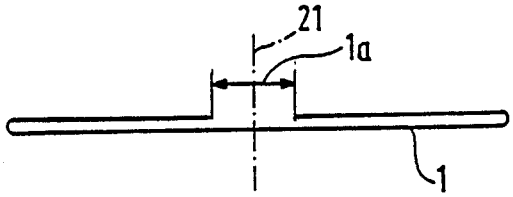
FIGS. 20 through 22 are a schematic representation of the manufacturing procedure for a carrying bag according to FIG. 14.
Figure 21:
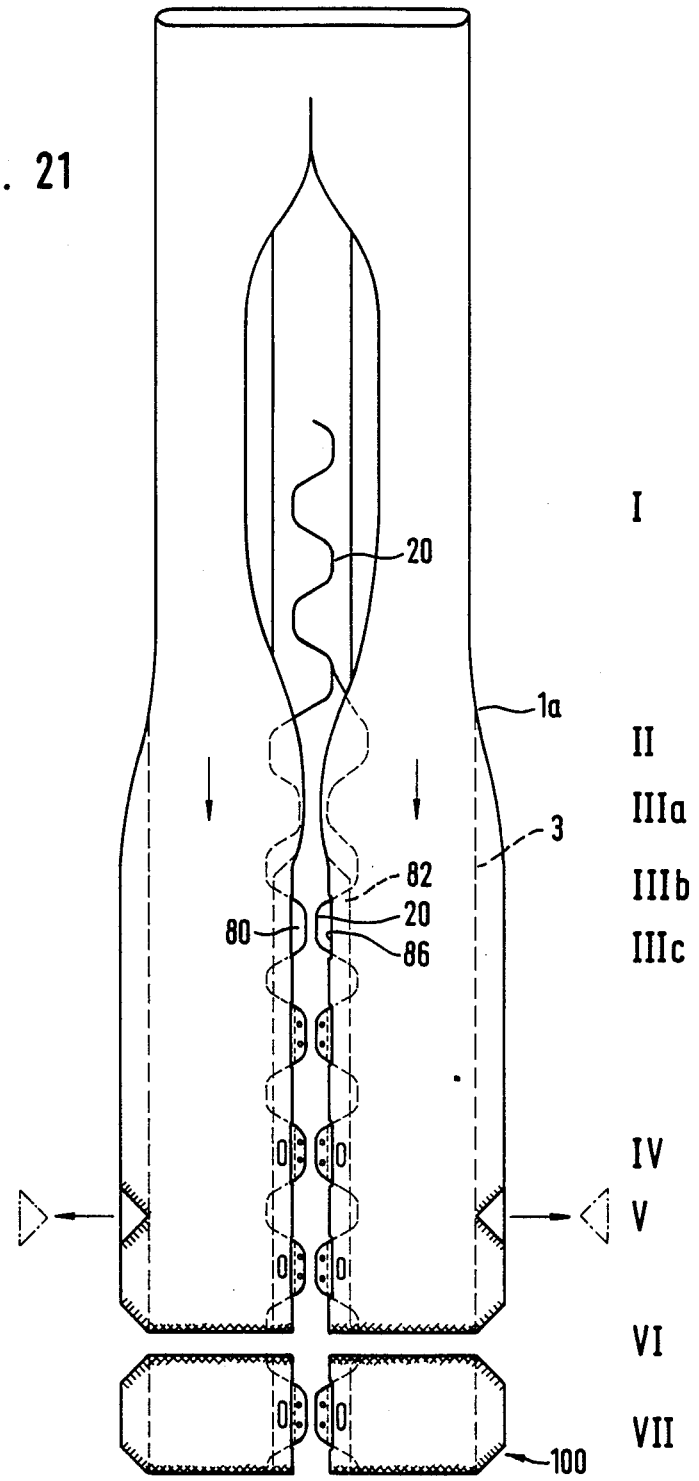

FIG. 21 shows schematically a manufacturing process for a carrying bag according to FIG. 14. The starting material herein is a laid-flat tubular sheet 1 (see schematic cross-section of FIG. 20); this sheet is cut open unilaterally along the center line 21 and the opening gap la is formed by pulling apart and/or by folding over the opening rims of the film toward the outside or by a correspondingly folded flat film 1. By means of this starting material, it is then possible to manufacture in a double-web fashion in parallel two identical bags in mirror-image symmetry. After flattening the tubular film and unilateral cutting open and spreading apart, the sinusoidal severing cut 20 can then be performed in the film ply 1 lying in opposition to the opening gap 1*a*, which is done in the cutting station I, and subsequently the mutual shifting of the two cut-part sheets is effected so that the wave crests and wave troughs of the sinusoidal cutting edge 20 are further transported in the direction of the arrow at the same level. In order to permit an easy, perfect sinusoidal cutting open of the film on one side, it can be advantageous to once more fold over the film edges along the opening gap 1*a* toward the outside (see FIG. 20), in order to then provide adequate space for the sinusoidal cutting tool. The opening gap should be somewhat wider than the amplitude height of the sinusoidal cut. It can also be expedient to arrange a spacer plate on the film side lying in opposition to the sinusoidal cutting tool. In subsequent stations IIIa, IIIb, IIIc, the bottom pleats 3 can then be inserted along the side edges of the cut-open film sheets, and the inverting flap 82 can be folded inwards along the linear opening cutting edges. Also, other folding operations can be performed. The process is conducted continuously in the cutting and fold-applying stations. The perforation and punching of hanging holes into the projecting flap 80 of the sinusoidal rim, formed by the bottom film ply, which can be done prior to or after the punching of the handle hole, as well as the welding operation, take place cyclically in discontinuous fashion. In the scope of discontinuous cyclic mode of operation working on bag sections, it is also possible to carry out the punching of the insert slot 86 into the flap edge of the inverted flap in an adequate width (length) at a suitable location. Also, the sequence of transverse welding of the corner weld seams in station V and the handle hole punching in station IV can be conducted in reverse order. When fashioning the corner weld seams 5 as a flush seam, the punching away of the corner sections, if desired, takes place either immediately in the corner welding station or in one of the subsequent stations. After leaving the transverse welding station VI, the cut-to-size carrying bags 100 can be collected loosely or in blocked packs optionally perforated and provided with hanging holes, in the subsequent collecting and depositing station VII.

The depositing of the bags can preferably take place on conventional pin stacking depositories.

Figure 22:
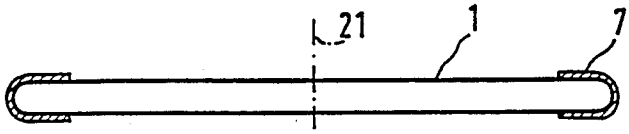

In place of a film tube having a uniform wall thickness or a flat film with uniform wall thickness, it is also possible to utilize a film 1 with strips reinforced in the zone of the subsequent bottom pleats 3, for example, in the form of extrusion-thickened areas 7, preferably in case of flat films or laid-flat tubular films, or in the form of reinforcing strips of thermoplastic film glued or welded onto the outside or inside—in which case preferably only localized welding areas or glued areas are provided; see also FIG. 22. The products thus are shopping or like bags 100 having a reinforced bottom region, i.e., especially a flat bottom reinforced as compared with the remaining bag walls, exhibiting improved standing strength and also load-bearing ability. The reinforcing strips can be manufactured from the same material as the tubular film for the bags, or also of another suitable material optionally exhibiting a higher strength.

Figure 17:
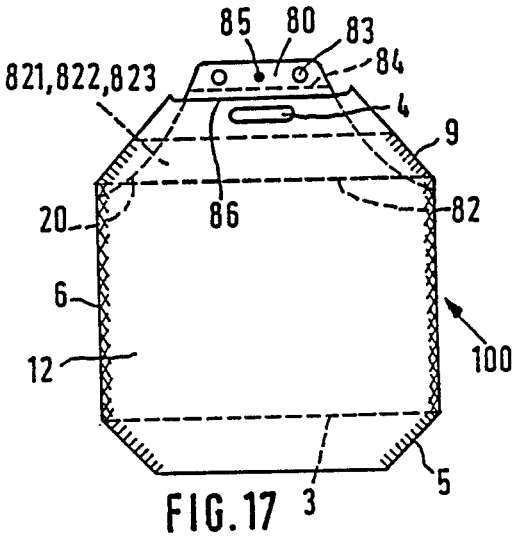
FIG. 17 shows a carrying bag in an elevational view with folding flap.
Figure 18:
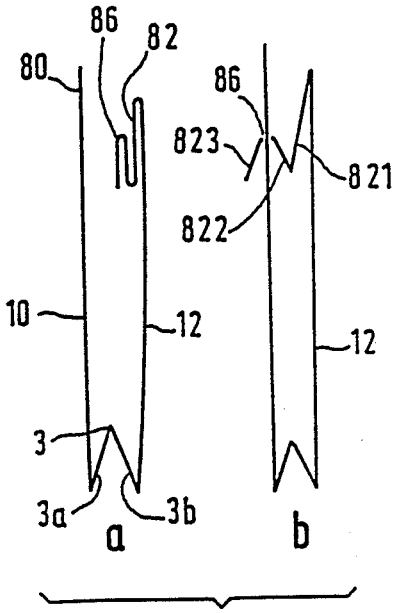
FIGS. 18 and 19 show lateral views of the carrying bag according to FIG. 17.
Figure 19:
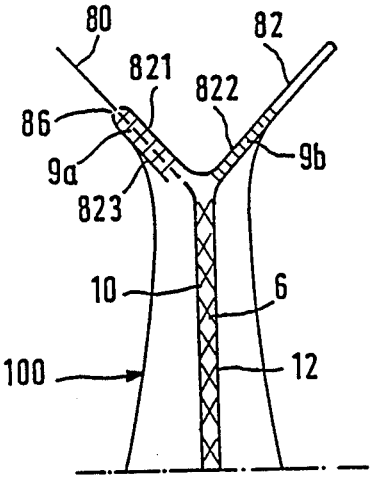
Figure 22A:
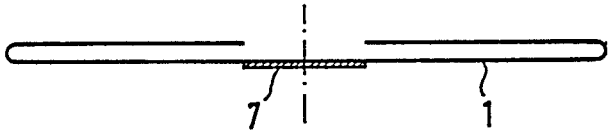
Figure 23:
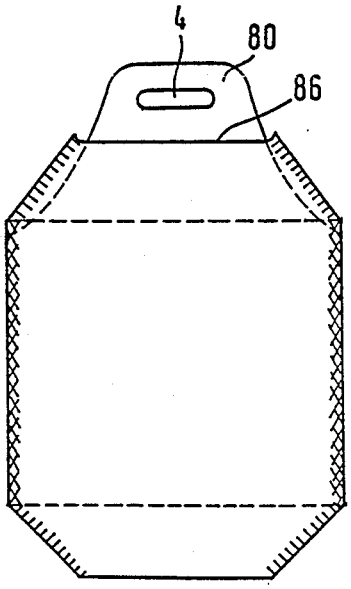
FIGS. 23 and 24 show elevational views of a carrying bag, likewise with folding flap.
Figure 24:
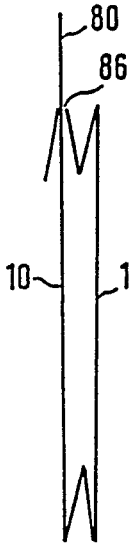

For carrying bags having a high filling volume with optimum space utilization, it is suggested in connection with a bag design that is sealed after filling to create also at the bag opening a sealing fold by means of a correspondingly fashioned, folded flap. One embodiment of such a bag with sealing fold is illustrated in FIGS. 17 to 19 in a front view, two longitudinal cross-sections, and a partial lateral view. The shopping bag 100, according to FIG. 17, comprises the longitudinal cutoff weld seams 6, the bottom pleat 3, and the corner weld seams 5 extending in the pleat portions 3*a*, 3*b* of the bottom pleat from the lateral edges to the bottom pleat edges. The bag rear wall 10 exhibits in the opening zone the sinusoidal load-bearing rim 20 with the projecting flap 80. At the front wall 12 of the bag, along the load-bearing rim, the flap 82 is inverted inwardly over the entire bag width and is once more folded over along at least part of the height so that the three folding lanes 821, 822, 823 are formed (see FIGS. 18*a* and 18*b*). The fold portions 822 and 823, as well as the fold portion 821 and the adjoining front wall 12 of the bag are joined by corner weld seams extending obliquely from the lateral cutoff weld seams, and the corner sections are cut off. In this way, analogously to the flat bottom, a sealing fold is formed in the zone of the bag aperture. In the outwardly located folding edge between the folding lanes 822 and 823, a pass-through slot 86 is punched out in the central zone, through which the flap 80 of the bag rear wall can be passed if desired. The handle holes 4 are punched in within the upper zone of the bag front wall and rear wall above the closure formed by the folding lanes. It is also possible to punch a handle hole 4 only into the protruding flap 80 of the bag rear wall, as illustrated, for example, in connection with the bag 100 according to FIG. 23 with a longitudinal section according to FIG. 24. In this embodiment of the bag 100, the folding lanes of the inwardly folded flap rim of the bag front wall 12 can be folded to be of equal length, as can be seen schematically from FIG. 24. It is also advantageous to design the projecting flap 80 with handle hole 4 to be reinforced as compared with the remaining bag walls, in that, for example, a handle leaf is welded on or glued on, or in that the flap 80 is made of a zone 7 of extrusion-thickened film (see the schematic view of FIG. 22*a*).

FIG. 19 shows in a fragmentary more detailed view the shape of the corner weld seams 9 of the folding lanes 821, 822, 823 and of the bag front wall 12 for forming the sealing fold, with formation of the corner weld seams 9*a*, 9*b* in the individual fold portions. In order to make it possible to provide flawless design of the corner weld seams 9, the load-bearing rim 20 of the bag rear wall 10 is preferably extended downwardly along the lateral cutoff weld seams 6 of the bag 100 to such degree that the rim terminates underneath the flap portions folded over at the bag wall 12 on the front side. The projecting flap 80 of the bag rear wall can be fashioned, as indicated in the bag of FIG. 17, as an interlocking section with interlocking weld zones 85, hanging holes 83, and a tear-off perforation 84. The bags 100 can be provided in loose form as well as interlocked.

Figure 25:
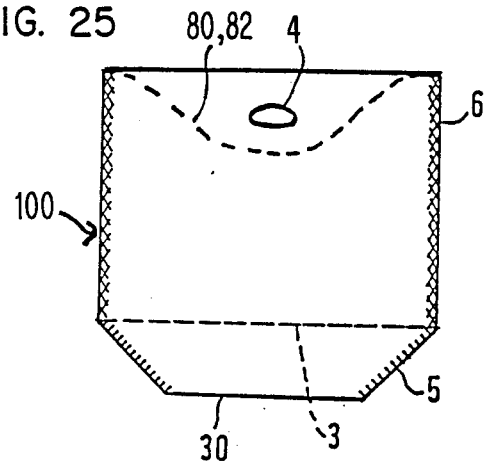
FIG. 25 shows a carrying bag with completely folded-in sinus flaps.
Figure 26:
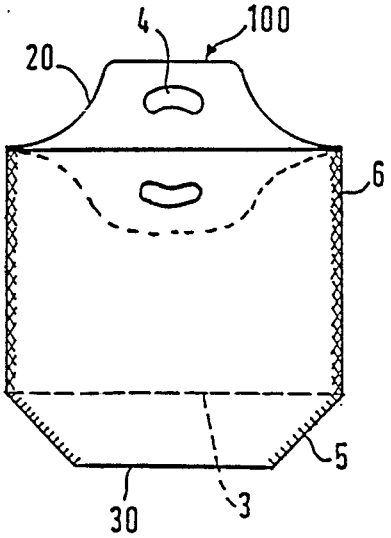
FIG. 26 shows a carrying bag with a folded-in sinus flap.
Figure 27:
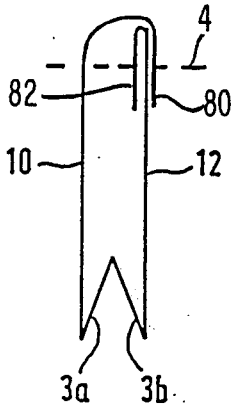
FIG. 27 shows a side view of a sealed carrying bag according to FIG. 25 or 26.

Additional modifications of bags with a flat bottom can be obtained, as illustrated in FIGS. 25 to 27, by folding over one or both sinusoidal flaps 80, 82, i.e., the wave crests of the carrying bag, toward the inside.

In the bag 100, according to FIG. 25, the wave crests are folded inwards as flaps 80, 82 in accordance with the progression of the process depicted in FIG. 4 still prior to the punching of the handle holes 4, and thereafter the handle holes ar punched through the film plies and flaps. One of the folded-in flaps can be welded to the adjoining film wall in the handle hole zone. As can be seen from the schematic cross-section of FIG. 27, the loosely folded flap 80 can, for example, be pulled out after filling the shopping bag 100 and can be placed from the outside over the front wall 12 so that the bag aperture is sealed. The carrying bag can be grasped through the handle hole provided in each case through the front wall 12, the rear wall 10, and the flap folds 80, 82.

FIG. 26 shows the bag 100 of FIG. 25 with only one inwardly folded flap 82 which can likewise be welded to the contacting wall around the handle hole 4. The upright-standing sinusoidal flap which has not been folded over can, after filling of the bag, likewise be laid over the aperture, as shown in FIG. 27.

I claim:

1. A process for the paired production of carrying bags having a front wall and a rear wall joined by lateral weld seams and a bottom pleat from thermoplastic synthetic resin sheeting which comprises the steps of conveying a tubular sheet with folded outer longitudinal edges and upper and lower film plies of synthetic resin film along a path; cutting open the tubular sheet in a straight cut at a central portion on the upper film ply of the tubular sheet thereby providing longitudinal straight edges at the resulting upper film plies; forming an opening gap by pulling the upper film plies apart transversely to the conveying direction of the severed film edges so that the opening gap formed is wider than the amplitude height of a sinusoidal severing cut to be executed on the lower film ply lying beneath the opening gap; continuously cutting open the lower film ply in a sinusoidal separating cut in the conveying direction to form longitudinal edges with wave crests and wave troughs within the opening gap and pulling apart the thus-created semitubular sheets transversely to the conveying direction; offsetting said semitubular sheets longitudinally with respect to each other until the wave crests and wave troughs of the two sheets are guided in a parallel side-by-side relationship; inserting W-folds with upper and lower fold portions bilaterally extending along outer longitudinal edges of each semitubular sheet thereby forming bottom pleats; folding upper film plies along straight edges over inwardly to form a flap to such an extent that a wave trough of the lower film ply edge extends outside of the resulting folded over film edge; then cyclically conveying the sheets intermittently; punching at least one handle hole in at least the lower film ply; punching pass-through slots successively along the folded-over flap edge and optionally punching tear-off perforations and hanging holes into the sinusoidal wave crest protruding with respect to the folded-over film edge; welding corner weld seams extending in the upper and lower fold portions of the W-folds of two successive bags in angular form surrounding corner sections of the fold; then producing lateral weld seams by transverse cut-off welding with separation of the corner weld seam angles; and separating the resulting bags in pairs.

2. A process according to claim 1, wherein the flap edge is folded in a W-shape.

3. A process according to claim 1, wherein the tubular sheet is reinforced in the zone of the subsequent bottom pleats with strips of thermoplastic films.

4. A process according to claim 1, wherein after welding corner weld seams extending in the upper and lower fold portions of the W-folds, cutting off corner sections.

5. A process according to claim 1, wherein the handle holes are also punched into the folded over film flap.

* * * * *